United States Patent [19]

Anderson

[11] 4,219,909

[45] Sep. 2, 1980

[54] COMBINED CLASP AND TIE SLIDE

[75] Inventor: Olof V. Anderson, North Kingstown, R.I.

[73] Assignee: Anson Incorporated, Providence, R.I.

[21] Appl. No.: 5,437

[22] Filed: Jan. 22, 1979

[51] Int. Cl.[2] ..... A41D 25/04

[52] U.S. Cl. ..... 24/49 R; 24/49 CF; 24/49 C; 24/49 P

[58] Field of Search ..... 24/49 R, 49 A, 49 CF, 24/49 C, 49 K, 49 CP, 49 S, 49 M, 49 CC, 49 KC, 52

[56] References Cited

U.S. PATENT DOCUMENTS

| | | | |
|---|---|---|---|
| 1,973,009 | 9/1934 | Mix | 24/49 P |
| 2,001,261 | 5/1935 | Manaster | 24/49 CF |
| 2,195,594 | 4/1940 | Kreisler | 24/49 CF |
| 2,272,674 | 2/1942 | Kehr | 24/49 C |
| 2,402,956 | 7/1946 | Fyfe | 24/49 CF |
| 2,460,728 | 2/1949 | Aversa | 24/49 K |
| 2,514,048 | 7/1950 | Gragg et al. | 24/49 CF |
| 2,603,016 | 7/1952 | Mix | 24/52 |
| 2,994,116 | 8/1961 | Anderson | 24/49 C |
| 3,049,772 | 8/1962 | Anderson | 24/49 C |
| 3,609,823 | 10/1971 | Boots | 24/49 CF |

*Primary Examiner*—Victor N. Sakran

*Attorney, Agent, or Firm*—William Frederick Werner

[57] ABSTRACT

This invention relates to a combined structure of a clasp and tie slide designed for use in removably attaching a clasp to a shirt front, whereby a tie slide, adjustable to accommodate neckties of varying widths, holds the necktie in proper relation to the front of the shirt.

6 Claims, 9 Drawing Figures

COMBINED CLASP AND TIE SLIDE

STATEMENT OF INVENTION

This invention relates in general to a combined structure of a removably adjustable clasp attaching a necktie slide to a shirt front.

PRIOR ART

The present clasp assembly represents an improvement upon necktie clasps such as disclosed in U.S. Pat. Nos. 3,049,772 and 2,994,116.

OBJECTS OF THE INVENTION

One of the objects of the present invention is to provide a clasp embodying novel and improved features of construction whereby the clasp shall be capable of being attached to a shirt front to prevent displacement and ensure against slipping or loss of clasp while being attached to a necktie slide for holding a necktie in proper relation to a shirt front.

Another object of the present invention is to provide a clasp comprising one jaw attached to the body of a tie slide or other structure which serves as a second jaw, and novel and improved means for mounting a spring clamping strip on one of said jaws in opposed clamping relation to the other jaw, whereby the tie slide and clasp are integral, simple and inexpensive in construction and appealing to the eye.

Other objects of the present invention will become apparent in part and be pointed out in part in the following specification and claims.

BRIEF DESCRIPTION OF DRAWINGS

Referring to the drawings in which like reference numerals refer to like parts.

Figure 1:
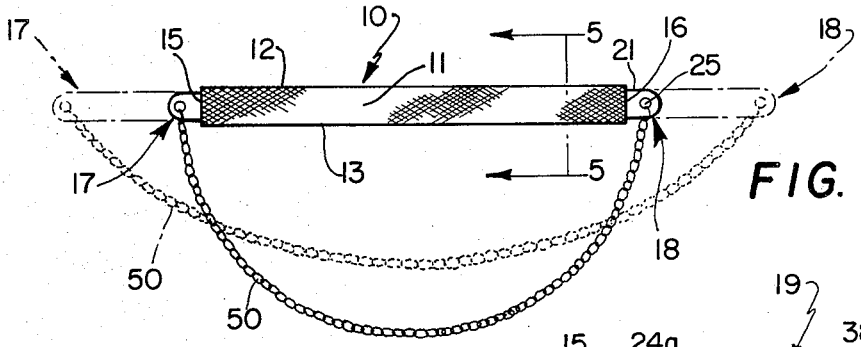
FIG. 1 is a front elevational view of the combined clasp and tie slide.
Figure 2:
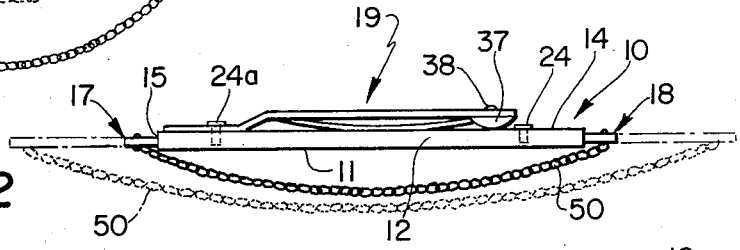
FIG. 2 is a rear elevational view of FIG. 1.

In proceeding with this invention, there is provided a hollow elongated box type structure having open opposite ends, generally indicated by reference numeral 10, comprising a face plate 11, a top side 12, a bottom side 13, a back side 14, a left end 15 (as viewed in FIG. 1) and a right end 16.

Figure 3:
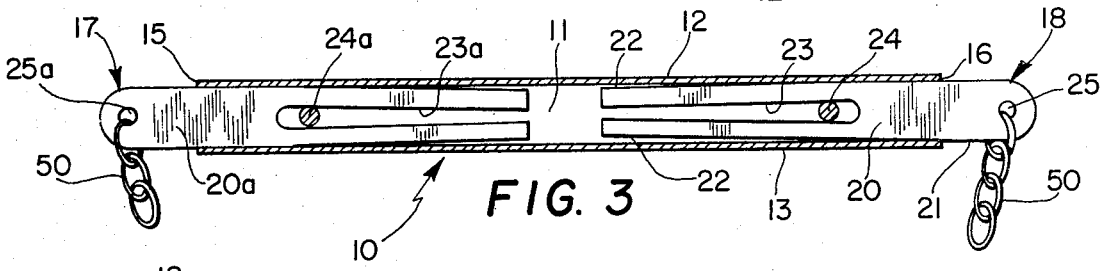
FIG. 3 is a medial horizontal cross sectional view through the body of the tie slide.
Figure 5:
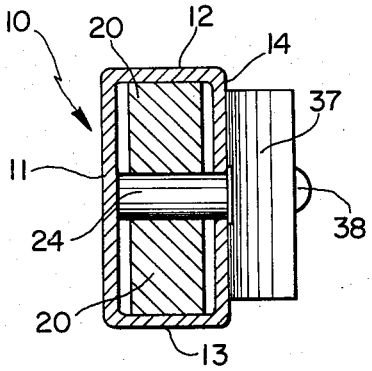
FIG. 5 is a vertical cross sectional view, taken on line 5—5 of FIG. 1.
Figure 4:
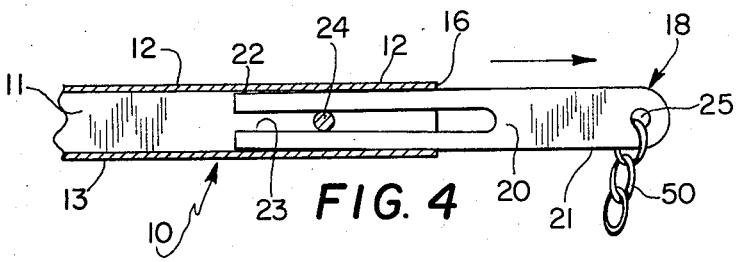
FIG. 4 is a fragmentary view, similar to FIG. 3, showing one leg of the tie slide in extended position.
Figure 6:
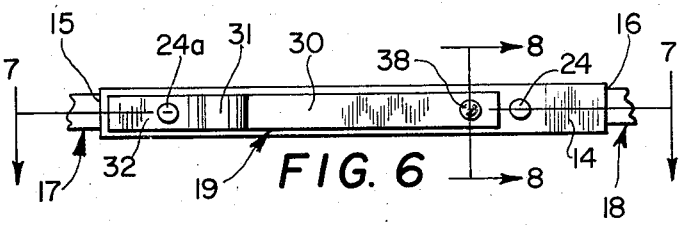
FIG. 6 is a bottom plan view of FIG. 1.
Figure 7:
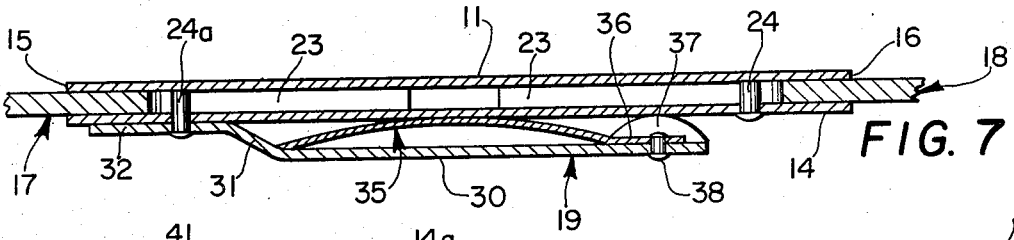
FIG. 7 is a medial cross sectional view, taken on line 7—7 of FIG. 6, looking in the direction of the arrows.

Two sliding legs are generally indicated, respectively, by reference numerals 17 and 18. Leg 18 comprises a flat body 20 having a wide portion 21 of a size to slidably engage top side 12 and bottom side 13 on the inner surfaces thereof. Said wide portion 21 extends approximately two-thirds the length of flat body 20. The other one-third 22 of said length is tapered away from said top side 12 and bottom side 13, for purposes which will presently appear. Flat body 20 is provided with a tapered elongated slot 23. A rivet 24 is fastened to face plate 11 and back side 14 (see FIGS. 3, 4 and 7). Elongated slot 23 straddles rivet 24 and is slidably mounted thereon. As sliding leg 18 is withdrawn from box 10, rivet 24 engages the sides of tapered elongated slot 23 and spreads leg 18 outwardly, with the tapered portion 22 spreading toward top side 12 and bottom side 13. The spreading action creates friction between the sides of elongated slot 23 and the sides of rivet 24 to frictionally hold leg 18 in selected extended position. An orifice 25 is provided in flat body 20.

In like manner, leg 17 comprises a flat body 20A having a width portion 21A of a size to slidably engage top side 12 and bottom side 13 on the inner surfaces, thereof. Said width portion 21A extends approximately two-thirds the length of flat body 20A. The other one-third 22A of said length is tapered away from said top side 12 and bottom side 13. Flat body 20A is provided with a tapered elongated slot 23A. A rivet 24A is fastened to face plate 11 and back side 14. Elongated slot 23A straddles rivet 24A and is slidably mounted thereon. As sliding leg 17 is withdrawn from box 10, rivet 24A engages the sides of tapered elongated slot 23A and spreads leg 17 outwardly, as previously described for leg 18.

A clasp, generally indicated by reference numeral 19, comprises a first jaw (see FIG. 7) having a flat body 30 and an arm 32 integrally connected by a bight 31 or inclined plane. One end of flat body 30 is provided with two opposite and parallel wings 37 or spring guide surfaces. A rivet 24A fastens arm 32 to back side 14. Said rivet 24A is fastened to face plate 11. An arcuate shaped leaf spring, generally indicated by reference numeral 35, is provided with a flat seat 36, and arches to terminate at the base of inclined surface 31. Flat seat 36 is located between spring guide surfaces 37 and is fastened to flat body 30 by means of rivet 38. Back side 14 serves as a second jaw in cooperation with first jaw 30. Arcuate shaped leaf spring 35 resiliently engages second jaw 14. When a shirt front is interposed between spring 35 and second jaw 14, the resilience of said arcuate shaped leaf spring 35 is enhanced by the friction created by the end of spring 35 riding upwardly upon the inclined plane 31.

A jewelry chain 50 is fastened on opposite ends to flat bodies 20, 20A, respectively, at orifices 25, 25A, respectively.

When clasp 19 is fastened to a shirt front, a necktie may be passed between jewelry chain 50 and face plate 11, whereby the necktie is loosely held in position in relation to the shirt front.

MODIFIED FORM

Figure 9:
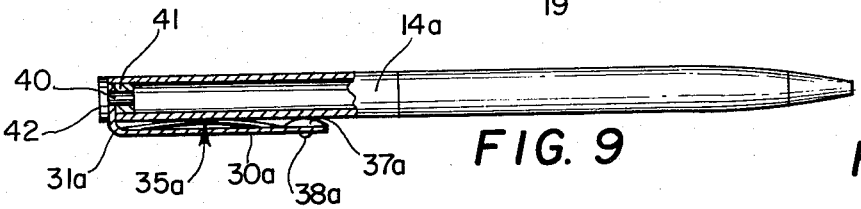
FIG. 9 shows a writing instrument provided with the clasp structure of the present invention.
Figure 8:
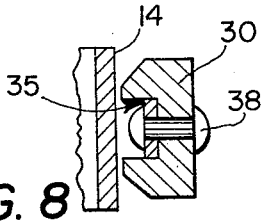
FIG. 8 is a cross sectional view, taken on line 8—8 of FIG. 6, looking in the direction of the arrows.

FIG. 9 illustrates the new and improved clasp attached to a writing instrument, comprising a first jaw 30A and a second jaw 14A, said first jaw having a bight 31A and an arm 32A, an arched spring clamping strip 35A having a flat seat 36A and a free end, means 38A fastening said flat seat 36A to said first jaw 30A with said free end slidable upon said inclined plane 31A, and a second means fastening said first jaw to said second jaw with said arched spring clamping strip resiliently engaging said second jaw 14A.

The arm 32A is provided with an orifice 40. Second jaw 14A may be the barrel of a writing instrument provided with a plug 41 driven into the barrel. A cap 42 provided with a tongue 43 fastens arm 32A to second jaw 14A by means of tongue passing through orifice 40 and fastening itself in plug 41 through an opening provided for that purpose in the form of a drive fit.

Having shown and described preferred embodiments of the present invention by way of example, it should be realized that structural changes could be made and other examples given without departing from either the spirit or scope of this invention.

What I claim is:

1. A combined clasp and adjustable tie slide comprising:

a. a hollow elongated structure having open opposite ends, a face plate, top and bottom walls and a back side;

b. Said top and bottom walls having generally parallel plane interior surfaces, c. a pair of elongated members slidingly engaging said structure, from said opposite ends, d. said members each having opposing plane edges which are generally parallel along a greater portion of the length of said members with said opposing plane edges inclining inwardly as tapered portions at respective first ends of said members, e. the width of each said member between its generally parallel plane edges being substantially equal to the distance between the interior surfaces of said top and bottom walls to thereby afford frictional engagement between said walls and the edges of said members proximate thereto, f. a tapered elongated slot extending axially inward from said first end of each said member, g. a separate rivet fastened to said face plate and said back side of said structure and extending across a related one of said slots, h. each said rivet serving to expand a related one of said tapered portions to a position whereby the plane edges of each said tapered portion frictionally engage the plane interior surfaces of said top and bottom walls of said structure as each of said members is slid relative to said structure, i. an elongated chain interconnected between respective second ends of said pair of members, and j. clasp means for attaching said structure to a garment of a wearer with said chain at least partially encircling a tie of said wearer, said members being slidably adjustable relative to said structure to extend said chain to a dimension to accommodate the width of said tie.

2. A device as set forth in claim 1 wherein said clasp means includes a jaw having an inclined surface, an arcuate leaf spring having a flat slot and a free end, fastening means securing said flat seat to said jaw, said free end of said leaf spring being engagable with said inclined surface, one of said rivets serving to fasten said jaw to said structure with said arcuate leaf spring resiliently engaging said structure and said free end being slidable on said inclined surface, whereby said garment of said user is engaged between said structure and said arcuate leaf spring.

3. A device as set forth in claim 2 wherein said greater portion of the length of each said member is generally two-thirds of the total length of said member.

4. A device as set forth in claim 2 wherein each said tapered slot is narrowest proximate to said the first end of its related member.

5. A device as set forth in claim 2 wherein each said member is of generally rectangular shape, and the interior of said hollow structure is also of rectangular shape.

6. A device as set forth in claim 2 wherein each said tapered slot has a rear wall which is engagable with the rivet extending across said slot to limit the extent of sliding movement of each said member into said structure.

* * * * *